US005121659A

United States Patent [19]

Williams

[11] Patent Number: 5,121,659

[45] Date of Patent: Jun. 16, 1992

[54] BLADE SHARPENER

[75] Inventor: David M. Williams, Chapel Town, England

[73] Assignee: McPherson's Limited, Australia

[21] Appl. No.: 761,325

[22] Filed: Sep. 17, 1991

[30] Foreign Application Priority Data

Sep. 17, 1990 [AU] Australia ..... PK2341

[51] Int. Cl.[5] ..... B21H 1/02; B21K 19/00

[52] U.S. Cl. ..... 76/86; 51/214; 76/82.2

[58] Field of Search ..... 51/205 R, 211, 214; 76/82, 72.2, 86; 30/138

[56] References Cited

U.S. PATENT DOCUMENTS

| | | | |
|---|---|---|---|
| 1,061,708 | 5/1913 | Vollmer | 76/86 |
| 4,604,836 | 8/1986 | Huang | 51/214 |
| 4,624,157 | 11/1986 | Forest | 76/86 |
| 4,699,337 | 6/1987 | Petroff | 76/86 |

*Primary Examiner*—Douglas D. Watts
*Attorney, Agent, or Firm*—Lerner, David, Littenberg, Krumholz & Mentlik

[57] ABSTRACT

A blade sharpener of the kind having a pair of overlapping plates which are relatively arranged to form a vee shaped sharpening recess between them. Each of the opposite sloping sides of that recess is formed by an operative edge of a respective one of the two plates, and each of those edges extends between a front face and a back face of the respective plate. A relatively sharp corner is formed between each operative edge and the back face of the respective plate, and a relatively blunt—e.g., rounded—corner is formed between each operative edge and the front face of the respective plate. The plates may be mounted on a member which can pivot between a position at which the plates tilt forward and a position at which the plates tilt back. Spring means may be operative to engage the back edge of a blade located in the recess so as to press the cutting edge of the blade against the plates. The arrangement is such that longitudinal movement of a blade through the recess in a direction towards the plate front faces, causes the sharp edges of the plates to be operative to sharpen the cutting edge of the blade, whereas in the reverse direction of the blade the blunt edges come into contact with the blade cutting edge so that sharpening of that edge does not occur.

16 Claims, 6 Drawing Sheets

BLADE SHARPENER

This invention relates to blade sharpeners, and is particularly but not exclusively concerned with knife and scissor sharpeners. It will be convenient to hereinafter describe the invention with particular reference to knife sharpeners, but the invention has other applications.

Examples of prior knife sharpeners are disclosed by U.S. Pat. Nos. 3,676,961, 3,774,350, 4,041,651, 4,091,691 and 4,805,350, and in each of those cases the sharpener is incorporated in a blade protective scabbard. A blade sharpener according to the present invention can be similarly incorporated in a scabbard, but can be also usefully employed separate from such a scabbard. A feature common to the sharpeners of the aforementioned U.S. patents is that the blade is sharpened during movement into the scabbard as well as during movement out of the scabbard. Some users find such two-way sharpening uncomfortable because of the force necessary to push a blade through the sharpening mechanism, whereas a similar difficulty is not experienced in pulling the blade through the sharpening mechanism.

The action of pushing a blade through a sharpener is seldom performed with the same degree of smoothness as is achieved when pulling the blade through the sharpener. Apart from the discomfort to the user, the difficulties associated with pushing the blade inwards tends to cause the blade cutting edge to be sharpened irregularly such that minute corrugations develop.

Two-way sharpening is also objectionable because it tends to unnecessarily reduce the useful working life of a knife blade. In that regard, it is thought to be unnecessary to always sharpen the blade during both directions of travel through the sharpener. Sharpening in one direction only is adequate in many cases, and has the advantage of removing less of the blade material during each sharpening operation.

Another problem with prior sharpeners is the difficulty of achieving effective sharpening along the full length of the blade cutting edge, particularly at the tip portion of the blade.

Still another problem exists with prior sharpeners of the scabbard mounted type, and that is the difficulty of gaining access to the sharpening mechanism for cleaning purposes. Over a period of time material tends to accumulate around the mechanism and it disturbs the effectiveness of that mechanism. Periodic cleaning is therefore required to maintain the mechanism in good working condition, but prior arrangements have not been designed to enable convenient access to and cleaning of the mechanism.

It is an object of the present invention to provide a blade sharpener which has a sharpening action in one direction only, or in which there is a predominant sharpening action in that direction and a less effective sharpening action in the opposite direction. In a preferred arrangement, the sharpening action, or the predominant sharpening action, is achieved by pulling a blade through the sharpener.

It is a further object of the invention to provide a blade sharpener which is effective to sharpen the entire length of a blade cutting edge, and which is convenient to clean. Still another object of the invention is to provide such a sharpener which is less likely to lose effectiveness due to absence of cleaning.

A sharpener according to the invention is unique in that the sharpening mechanism has a shape characteristic which operates to achieve one-way sharpening. The mechanism includes two overlapping plates of tungsten carbide or other sufficiently hard material which are relatively arranged to define between them a generally V-shaped sharpening recess. Each of the opposite sides of the recess are formed by a sloping edge of a respective one of the two plates, and each of those edges extends between two broad surfaces of the plate which, for convenience, will be referred to as front and back surfaces respectively. The aforementioned shape characteristic comprises a relatively sharp corner at the junction of the sloping edge and the back surface of each plate, and a radiused, curved, or other relatively blunt corner at the junction of the sloping edge and the front surface of each plate.

With an arrangement of the foregoing kind there will be no sharpening, or no effective sharpening, of a blade moved through the sharpening recess in a direction from the front surfaces of the plates towards the back surfaces thereof. That is because the relatively blunt corners of the plates constitute their leading corners under those circumstances, and those corners have no sharpening capacity because of their bluntness. Also, those blunt corners provide relatively low resistance to relative movement of an engaging blade. The trailing corners on the other hand are relatively sharp and will serve to sharpen a blade which is moved through the sharpening recess in a direction from the back surfaces of the plates towards the front surfaces thereof.

Tungsten carbide, and similarly hard sharpening plates, effect blade sharpening by cutting or scraping minute particles of material from the blade. The invention is equally applicable to sharpeners in which the sharpening elements function on the basis of an abrasive action.

It is preferred to mount the sharpening plates on a member such as a block which is arranged for limited back and forth movement about a pivot axis extending transverse to the general plane of a blade being treated by the sharpener. Stop means may be arranged to limit the range of pivotal movement of the block so that the plates are tilted forwardly and rearwardly respectively at the two extremities of that range. Preferably, the degree of tilt is greatest in the rearward position so as to maximise the sharpening defeating function of the aforementioned blunt corners.

In circumstances where the sharpening mechanism is mounted on a blade protective scabbard, a pivoted block arrangement as discussed above facilitates insertion of a blade into the scabbard. That is particularly so if the scabbard includes biasing means which automatically forces the blade and the sharpener plates into engagement so as to increase the frictional resistance to relative movement between the blade and the plates. Rearward tilting movement of the block is the initial response to engagement between the plates and an inwardly moving blade, and that gives an easy start to continuing inward movement of the blade. The blade engages the blunt leading corners of the rearwardly tilted plates during that continuing movement, and those corners provide little resistance to relative movement of the engaging blade.

According to a further aspect of the invention in a preferred form, the sharpening mechanism is connected to a front portion of a scabbard housing which is detachable from the remainder of the housing for cleaning or repair of the mechanism.

According to yet another aspect of the invention in a preferred form, the sharpening mechanism includes a sharpening device arranged for backwards and forward rocking movement, and a latch which is biased to engage the back edge of a blade arranged to have its cutting edge treated by the sharpening device. The relative arrangement between the sharpening device and the latch is such that there is effective sharpening along the full length of the cutting edge of a blade which is treated by the device.

Other aspects of the invention will be apparent from the following description of a particular embodiment of the invention. That embodiment will be described by reference to the accompanying drawings, and as it is especially suited for use in a scabbard-sharpener combination it will be described as part of such a combination. As previously stated however, a sharpener according to the invention has wider application.

Embodiments of the invention are described in detail in the following passages of the specification which refer to the accompanying drawings. The drawings, however, are merely illustrative of how the invention might be put into effect, so that the specific form and arrangement of the various features as shown is not to be understood as limiting on the invention.

Figure 1:
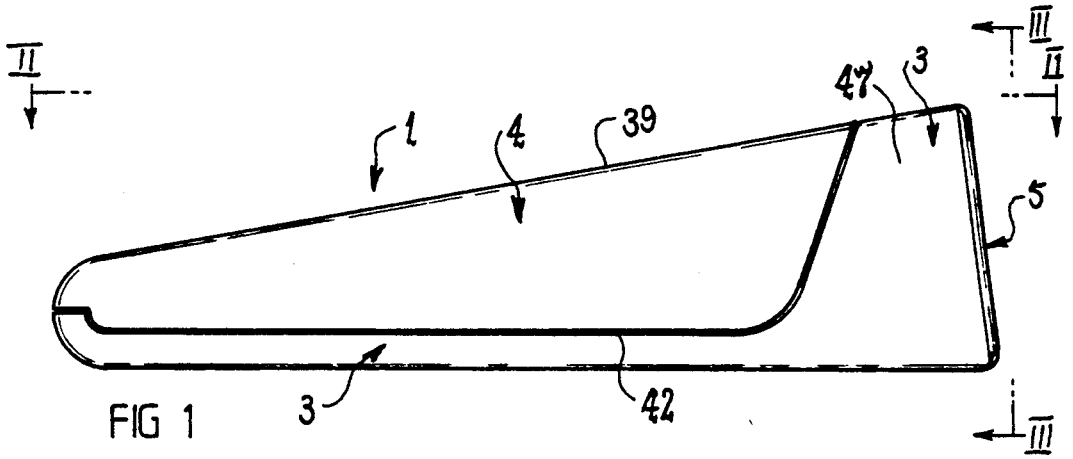
FIG. 1 is a side elevation view of one form of scabbard which may incorporate an embodiment of the invention.
Figure 2:
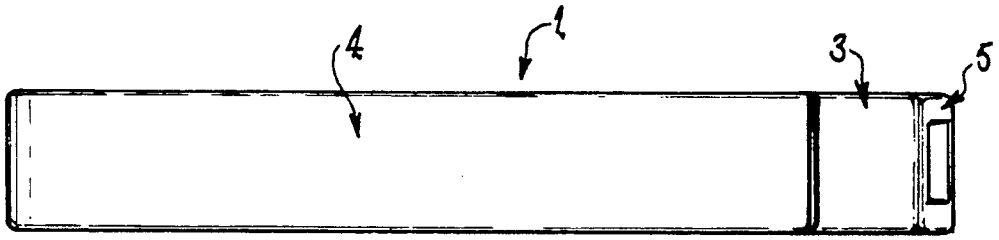
FIG. 2 is a top plan view of the scabbard shown in FIG. 1.
Figure 3:
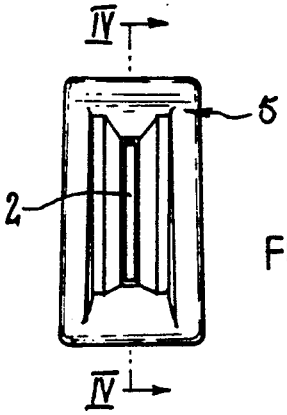
FIG. 3 is a front view of the scabbard taken along line III—III of FIG. 1.

FIGS. 1, 2 and 3 of the drawings show a typical scabbard 1 which might incorporate an embodiment of the invention. That scabbard 1 is hollow so as to receive the blade of a knife and has a blade access opening 2 at a front end as shown in FIG. 3. In the particular arrangement shown, the scabbard 1 is composed of a lower body part 3, an upper body part 4 and a removable front cap part 5 through which the opening 2 is formed. The construction of the scabbard 1 will be hereinafter described in greater detail.

Figure 4:
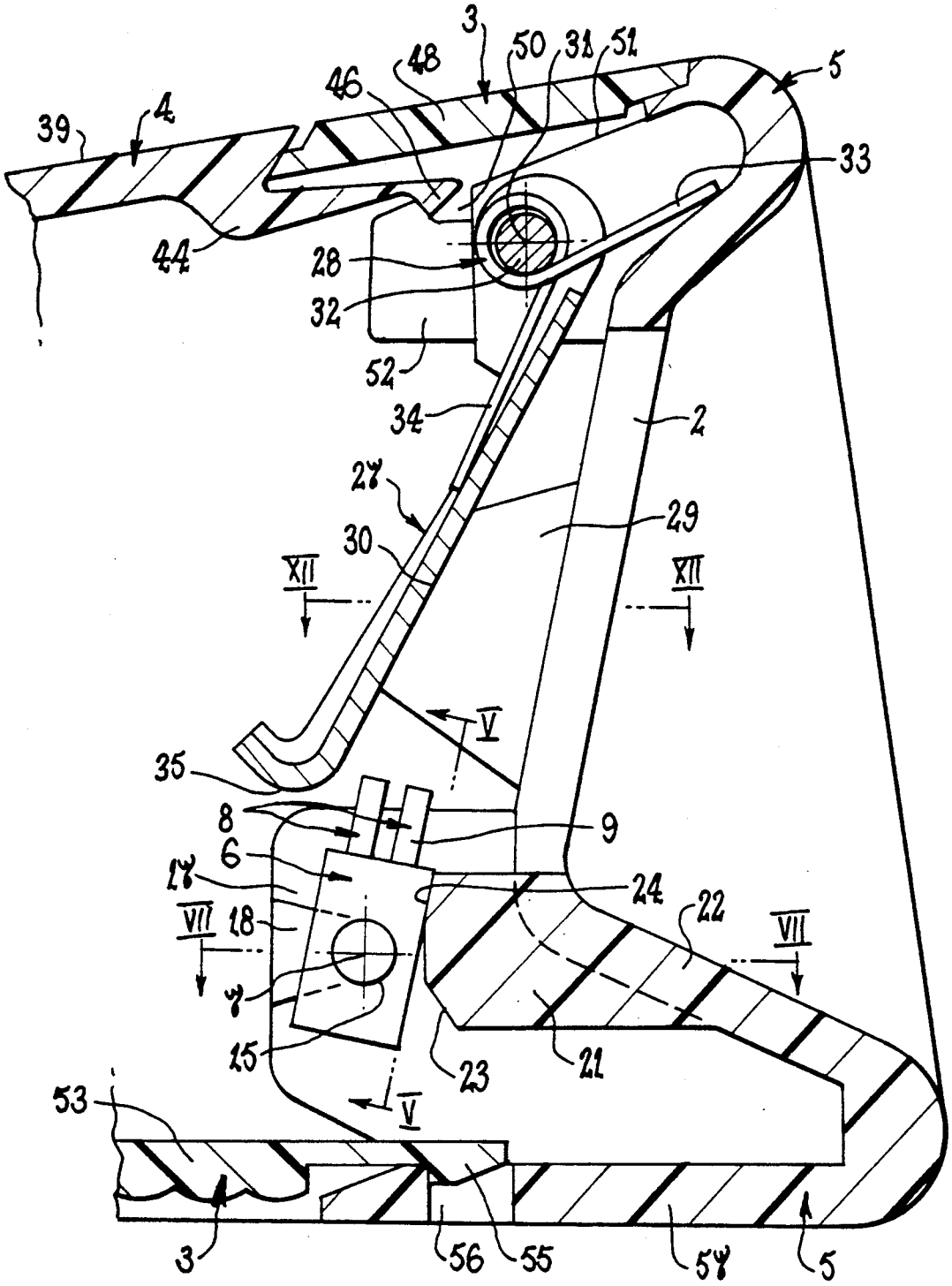
FIG. 4 is an enlarged cross-sectional view taken along line IV—IV of FIG. 3 and showing a front end portion of the scabbard.

FIG. 4 shows one form of sharpening mechanism incorporating an embodiment of the invention. That mechanism is mounted on the scabbard cap part 5 so as to be removable with that part from the body parts 3 and 4.

Figure 5:
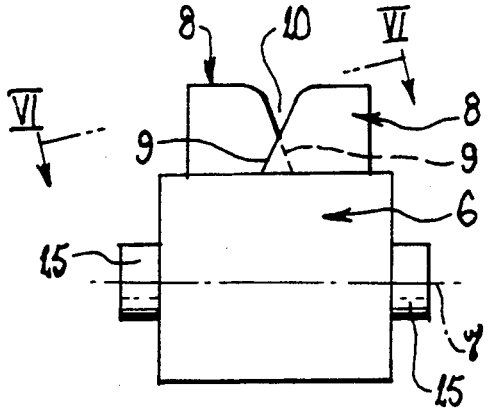
FIG. 5 is a view taken along line V—V of FIG. 4, with parts not being shown for convenience of illustration.

The particular mechanism shown includes a block 6 which is mounted for pivotal movement about an axis 7 extending transverse to the general plane of a blade positioned to be sharpened by the mechanism. A non-pivoting arrangement could be adopted, but is not preferred. A pair of sharpening plates 8 is mounted on the block 6, and in the particular arrangement shown those plates 8 are of tungsten carbide or other suitable hard material and are adapted to sharpen a blade by a scraping action. The plates 8 overlap as best seen in FIG. 5 and each has a sloping operative edge 9. The edges 9 are arranged to so as to form a V-shaped sharpening recess 10 between them. Although the edges 9 are generally relatively straight, they may be curved or otherwise deviate from a straight line.

It is a feature of the invention that a shape characteristic is applied to each plate 8 so as to obtain the desired one-way sharpening and a relatively smooth (low resistance) entry of a blade into the scabbard 1. In the embodiment shown, that is achieved in each of the plates 8 by applying a radius 11 to the corner formed by the operative edge 9 and the front face 12 of the plate. The opposite corner 13 between the edge 9 and the plate back face 14 is left relatively sharp so that it can perform the necessary sharpening of a knife blade.

The block 6 may be mounted in any appropriate fashion to effect the aforementioned pivotal movement. In the particular arrangement shown by FIGS. 4 to 7, a stub axle 15 is connected to or formed integral with each of two opposite sides of the block 6, and each axle 15 is rotatably located in a complementary hole 16 formed in a respective one of two mounting arms 17. The arms 17 are laterally spaced as shown by FIG. 7 and may be formed integral with the cap part 5 as shown. Each arm 17 may have sufficient flexibility to enable the arms 17 to be forced apart for installation of the block 6, and sloping ramp surfaces 18 provided on the inside of each arm 17 may assist in that regard.

Figure 8:
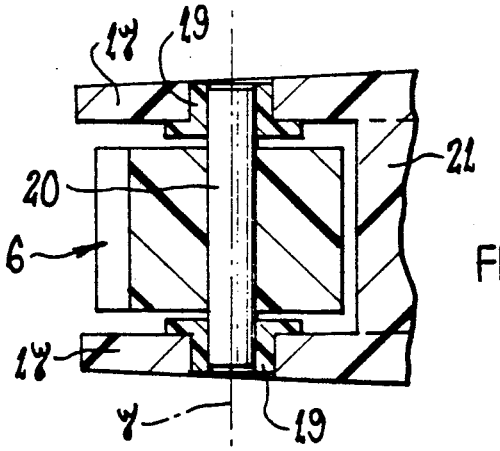
FIG. 8 is a view similar to FIG. 7 but showing another embodiment of the invention.

FIG. 8 shows an alternative mounting for the block 6. In that arrangement, a bush 19 formed of stainless steel or other suitable material is provided in each hole 16 and a pin 20, also of stainless steel or other suitable material, extends through the block 6 and is rotatably located in each bush 19. Such an arrangement provides for relatively free movement of the block 6 and avoids a problem sometimes encountered in all-plastic constructions. That is, manufacturing tolerances for plastic components must be such that the block 6 has sufficient freedom of movement to avoid sticking or jamming in one position.

Figure 10:
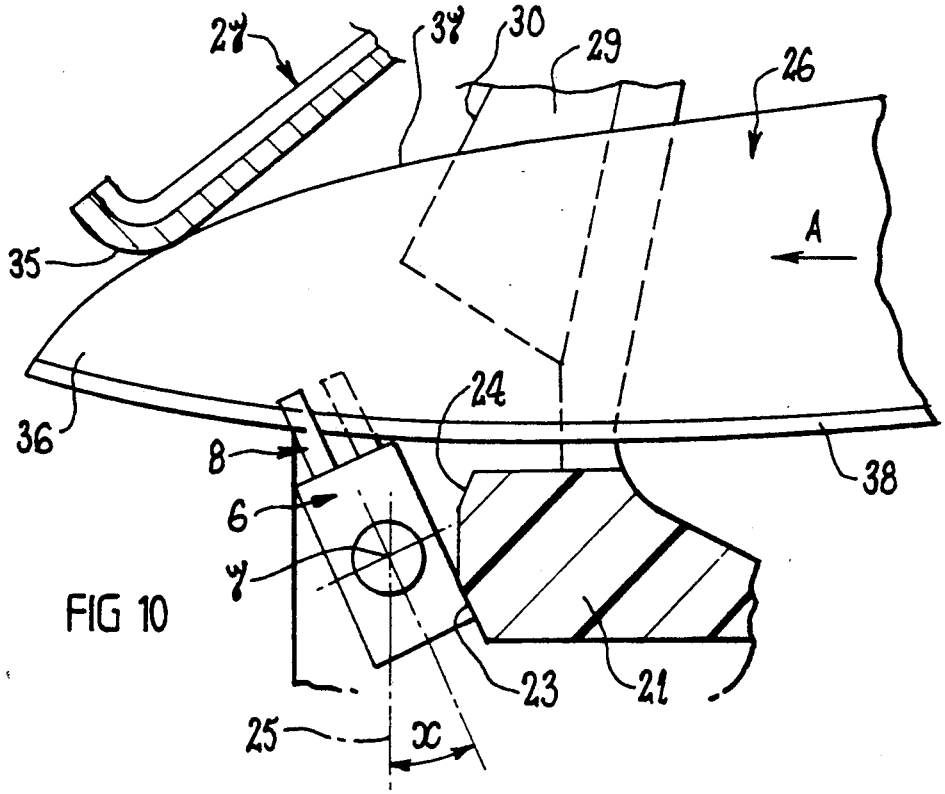
FIG. 10 is a view similar to FIG. 9 but showing the knife blade at a more advanced stage of insertion.
Figure 11:
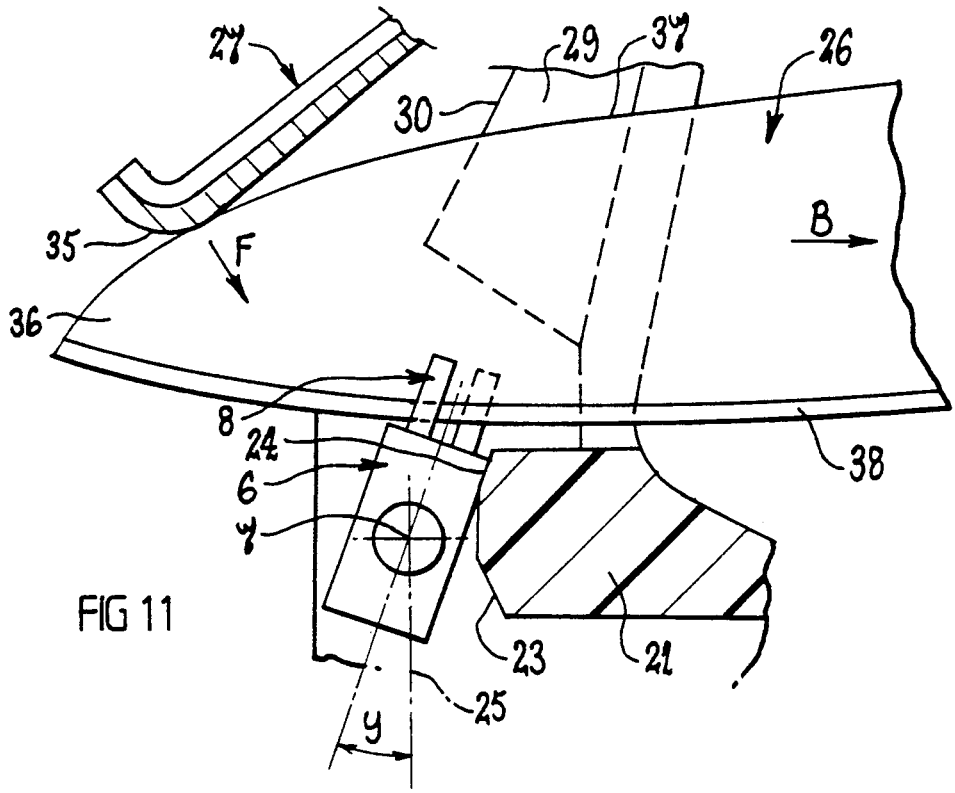
FIG. 11 is a view similar to FIG. 10 but showing the blade being withdrawn from the scabbard.

Stop means is provided to limit the degree of pivotal movement of the block 6, and preferably limits that movement in both the forward and rearward directions. In the construction shown, the stop means is formed by a rearward projection 21 of the front wall 22 of the cap 5, which may be moulded integral with that wall 22 as shown in FIG. 4. Two sloping stop faces 23 and 24 are provided on the projection 21 adjacent to the block 6 and arranged for engagement by that block. As shown by FIGS. 10 and 11, the block 6 engages the stop face 23 when tilted rearward, and the stop face 24 when tilted forward. It will be apparent that other stop arrangements could be adopted. In particular, there can be a separate stop member located on respective opposite sides of the block 6 so as to function in the forward and rearward directions respectively.

It is preferred that the degree of rearward tilt (FIG. 10) is greater than the degree of forward tilt (FIG. 11) by reference to an imaginary vertical plane 25. By way of example, the angle x of rearward tilt may be approximately 20° as compared with an angle y of forward tilt of approximately 10°. The larger rearward angle facilitates the intended operation of the radiused corners 11 of the plates 8—i.e., to deactivate the sharpening mechanism. The angle y is selected to achieve maximum sharpening benefit from the sharp corners 13 of the plates 8, given the particular circumstances of use of the sharpener.

Figure 12:
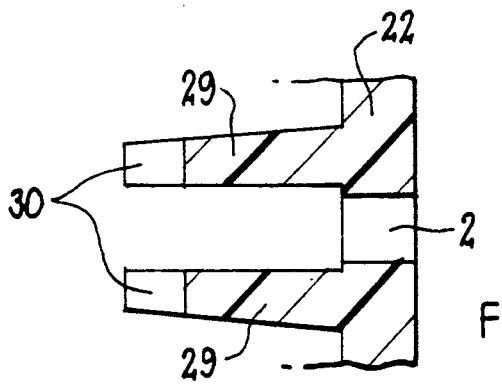
FIG. 12 is a cross-sectional view taken along line XII—XII of FIG. 4, with parts not being shown for convenience of illustration.

The particular sharpening mechanism shown also includes means for maintaining pressure between a knife blade 26 and the sharpening plates 8. According to the arrangement shown, that means includes a movable latch arm 27 and a spring 28 which biases the latch arm 27 to the rest position as shown in FIG. 4. The rest position is established by stop means, and in the constructions shown that stop means includes two abutments 29 (FIG. 12) which extend rearwardly from the wall 22 and are located on respective opposite sides of the opening 2. Each abutment 29 has a sloping stop surface 30 against which the latch arm 27 is engagable.

It is preferred that the latch arm 27 is movable about a pivot axis 31 as shown in FIG. 4, and it is further preferred that the pivot axis 31 is located forwardly of the pivot axis 7 of the sharpening block 6. The pivot is established by a pin 32 which is connected to the cap part 5 adjacent to the top of that part, and the biasing spring 28 may be mounted on that pin 32 as shown. Two arms 33 and 34 of the spring 28 bear against the part 5 and the arm 27 respectively so as to bias the arm 27 to the position shown in FIG. 4. Other spring arrangements are clearly possible.

Again as shown in FIG. 4, the latch arm 27 extends downwardly and rearwardly from the pivot axis 31 when in the rest position. The arrangement is such that the lower end portion 35 of the latch arm 27 is located behind, and close to, the sharpening plates 8 and overlaps those plates to some extent. It is also relevant, for a reason hereinafter explained, that the lower end portion 35 is curved as shown.

Figure 9:
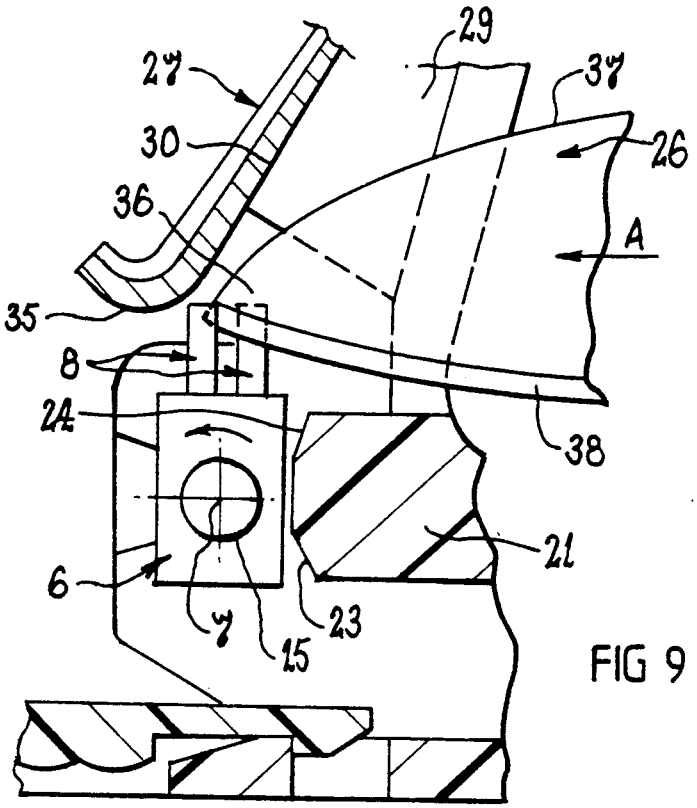
FIG. 9 is a view of the lower part of the mechanism shown in FIG. 4 and showing a knife blade being inserted into the scabbard.

When a knife blade 26 is inserted into the scabbard 1 through the opening 2, the tip end 36 of that blade will first engage the block 6, or the plates 8, as shown in FIG. 9. Because of the movement of the blade in the direction of arrow A, that engagement causes the block 6 to be swung rearwards about the pivot axis 7 until the block engages the stop face 23 as shown in FIG. 10. Continued movement of the blade 26 in the direction of arrow A results in the back edge 37 of the blade 26 contacting the latch arm 27, and that arm will be therefore caused to swing rearwards and upwards about the pivot axis 31 as shown in FIG. 10.

At the position of the block 6 as shown in FIG. 10, the cutting edge portion 38 of the blade 26 engages and moves over the radiused corners 11 of the sharpening plates 8. As a result, those plates 8 are ineffective to cause sharpening of the blade 26 and provide low resistance to relative movement of the blade. The blade 26 may be therefore pushed completely into the scabbard 1 without sharpening occurring, and the resistance to that movement will not be so great as to cause discomfort to the user. That is in spite of the fact that pressure is applied between the blade 26 and the plates 8 by the action of the latch arm 27. At the end of that inward movement of the blade 26, the lower end portion 35 of the latch arm 27 may be located close to the top wall 39 of the housing 1.

At commencement of withdrawal of the blade 26 from the housing 1 in the direction of arrow B (FIG. 11), the block 6 will be caused to flip over into the position shown in FIGS. 4 and 11. In that position, the plates 8 are effective to sharpen the blade 26 because the sharp edge 13 of each plate engages the blade cutting edge portion 38. Continued movement of the blade 26 in the direction of arrow B as shown in FIG. 11 causes the blade 26 to be sharpened. That sharpening is assisted by the force applied to the back edge 37 of the blade 26 by the latch arm 27 as shown in FIG. 11.

As the blade 26 approaches the final stage of withdrawal, the curved lower end portion 35 of the latch arm 27 presses against the blade back edge 37 at the tip end 36 of the blade 26, as shown in FIG. 11. It is generally the case that the back edge 37 is curved in that region. As a consequence, the latch arm 27 imposes a force on the blade 26 which has its line of action F (FIG. 11) acting generally towards the sharpening plates 8. The curved end portion 35 of the latch arm 27 therefore co-operates with the curved tip end part of the blade back edge 37 to press the cutting edge portion 38 against the plates 8, and continues to do that up to the very tip of the blade 26.

Several factors contribute to achievement of such sharpening over the full length of the blade 26. They include the relative positions of the pivot axes 7 and 31, the overlapping of the latch arm 27 and the plates 8 at the rest position of the arm 27, the location of the arm lower end portion 35 behind and adjacent to the plates 8 in the rest position of the arm 27, and the curved nature of the end portion 35.

Figure 13:
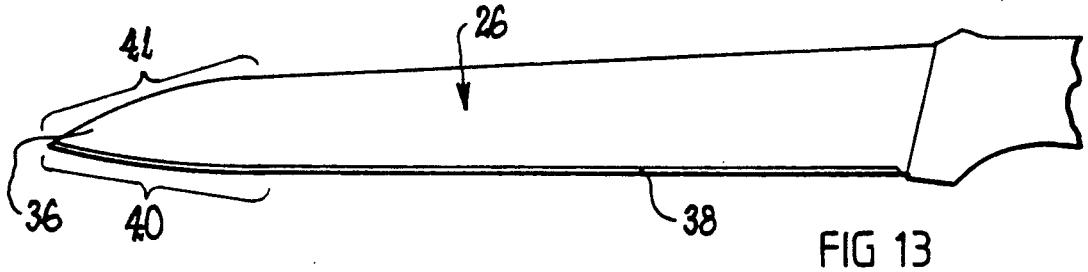
FIG. 13 is a side elevational view of a knife blade which is particularly suitable for use with the sharpener shown in the preceding drawings.

Optimum sharpening results are found to occur when the blade 26 has a configuration generally as shown in FIG. 13. A relevant factor of that shape is the relatively flat curvature applied to the cutting edge portion 38 over the tip end region 40, and the more pronounced or sharper curvature applied to the back edge 37 over the tip end region 41. The curvature over the region 41 co-operates effectively with the curved end portion 35 of the latch arm 27 to achieve the desired result.

It will be appreciated that satisfactory sharpening of blades can be achieved with blades having a shape different to that shown in FIG. 13.

The scabbard housing shown in the attached drawings has the advantage that the cap part 5, which carries the sharpening mechanism, is attached to the remainder of the housing 1 in a particularly secure manner. It is a feature of that attachment that co-operating fastening means exist at both the upper and lower sides of the housing 1. The remainder of the housing 1 in the arrangement shown, is formed by the upper and lower parts 4 and 3. Those parts 4 and 3 may be secured together in any appropriate fashion, such as by internal snap engaging lugs (not shown) which are located along both sides of the housing 1 and operate over the separation line 42 (FIG. 1) between the parts 4 and 3. The number and spacing of such lugs can be selected to suit requirements.

Figure 17:
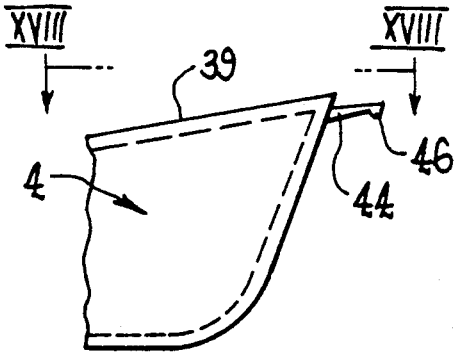
FIG. 17 is a side elevational view of a front portion of an upper part of the body of the scabbard shown in FIG. 1.
Figure 18:
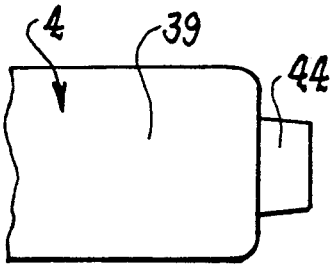
FIG. 18 is a plan view taken along line XVIII—XVIII of FIG. 17.

It is preferred that the attachment means for the cap part 5 be constructed and arranged as shown in FIGS. 4 and 14 to 18 of the drawings. The example upper attachment means shown includes a flexible finger 44 which is formed integral with the top wall 39 of the housing upper part 4, and projects forwardly from that wall 39 as shown in FIGS. 17 and 18. A downwardly projecting detent 46 is provided at the outer end of the finger 44.

In the construction shown, the housing lower part 3 is Provided with a stirrup section 47 (FIGS. 4 and 14) which extends the full height of the housing 1 and has a top wall 48. As best seen in FIG. 4, the stirrup top wall 48 is captured between the cap Part 5 and the top wall 39 of the housing upper part 4. That capture is secured by the detent 46 of the finger 44 snap engaging within a recess 50 (FIG. 4) Provided in the upper edge 51 of each of two side plates 52 of the cap part 5. Those plates 52 are laterally spaced to receive the latch arm 27 between them and, in the construction shown, provide a mounting for the pivot pin 32.

Figure 14:
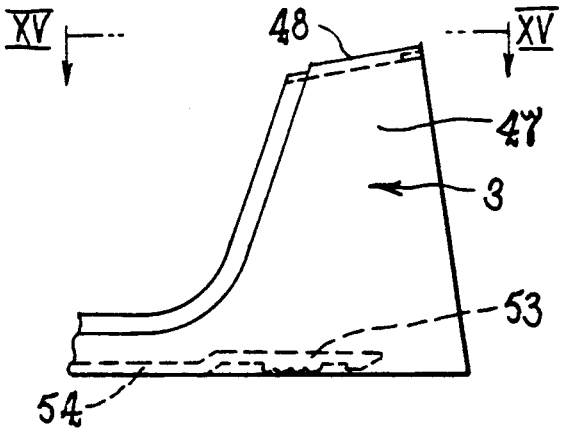
FIG. 14 is a side elevational view of a front portion of a lower part of the body of the scabbard shown in FIG. 1.
Figure 15:
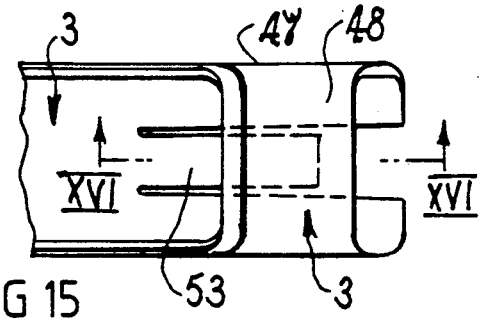
FIG. 15 is a plan view taken along line XV—XV of FIG. 14.
Figure 16:
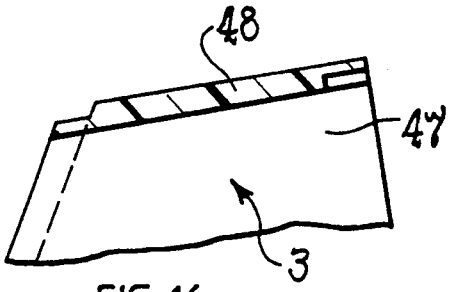
FIG. 16 is a cross-sectional view taken along line XVI—XVI of FIG. 15.

The example lower attachment means shown includes a flexible finger or catch 53 which is formed integral with a bottom wall 54 of the housing lower part 3 (FIGS. 4, 14 and 15). A detent 55 projects downwardly from the outer end of the finger 53 and snap engages within an opening or recess 56 formed in the bottom wall 57 of the cap part 5.

The combined effect of the upper and the lower attachment means is such that the cap part 5 is securely attached to the other housing parts 3 and 4. The upper attachment means also assist in holding the housing parts 3 and 4 together.

Release of the attachment means is effected by pushing upwards against the finger or catch 53 to release the lower side of the cap part. Outward movement of that lower side away from the stirrup section 47 then enables release of the detent 46 so that complete separation of the cap part 5 is effected. Replacement of the cap part 5 is achieved in the reverse fashion.

Figure 6:
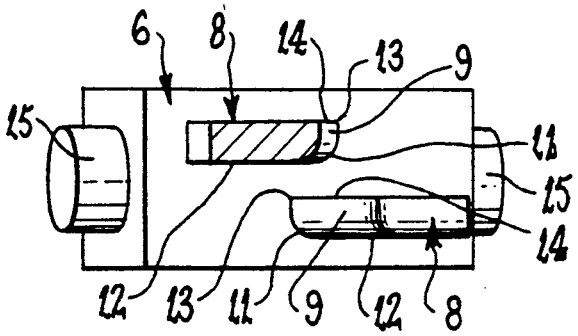
FIG. 6 is a cross-sectional view taken along line VI—VI of FIG. 5.
Figure 7:
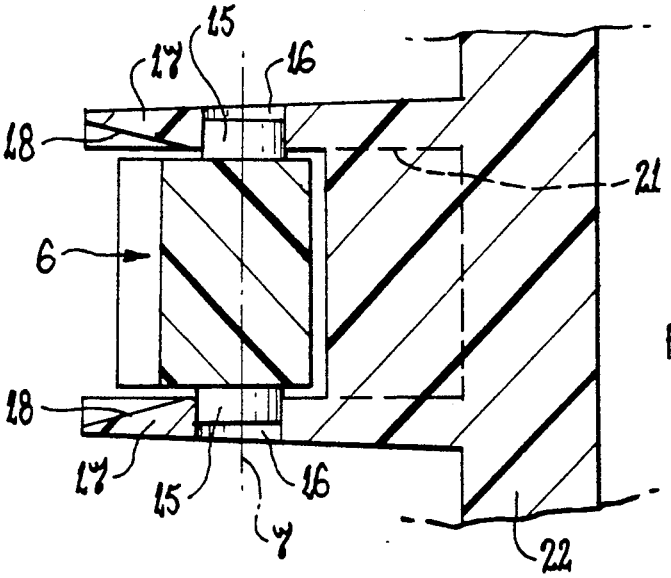
FIG. 7 is a cross-sectional view taken along line VII—VII of FIG. 4.
Figure 19:
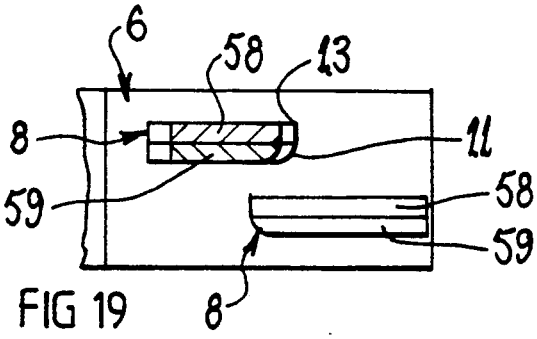
FIG. 19 is a view similar to FIG. 6 but showing another embodiment of the invention.

FIG. 19 shows a variation of the arrangement shown in FIG. 6 in which each plate 8 is composed of a laminate. One layer 58 of the laminate is formed of tungsten carbide or other suitable hard material, and has the sharp corner 13. The other layer 59 is formed of a material such as an abrasive material, which will hone or clean the cutting edge portion 38 of a blade 26 which is passed through the sharpening recess 10 in the direction of arrow A.

It will be apparent from the foregoing description that the present invention provides an improved blade sharpener and that the particular scabbard housing described has the advantage of simplicity without compromising on strength and durability.

Various alterations, modifications and/or additions may be introduced into the constructions and arrangements of parts previously described without departing from the spirit or ambit of the invention as defined in the appended claims.

Having now described my invention, what I claim as new and desire to secure by Letters Patent is:

1. A blade sharpener including a sharpening mechanism which is operable to sharpen the cutting edge of a blade engaging that mechanism and being moved longitudinally relative thereto, a pair of cutter plates forming part of said mechanism and each having a front surface, a back surface and an operative edge extending between those surfaces, said plates being relatively arranged so that there is an overlap between the plates and a generally vee shaped sharpening recess is formed between the two said operative edges, and each said plate has a relatively sharp corner formed between said operative edge and said back surface and a relatively blunt corner formed between said operative edge and said front surface, said sharp corners being operative to sharpen the cutting edge of a blade located in said recess and engaging said sharp corners when that blade is moved across those corners in a direction towards said front surfaces, and said blunt corners providing relatively low resistance to relative engaging the blunt corners, so that there is no effective sharpening of that cutting edge when it is moved across the blunt corners towards said back surfaces.

2. A sharpener according to claim 1, wherein each said operative edge is substantially straight, said plates are arranged in substantially parallel relationship, and each said blunt corner is curved in transverse cross-section.

3. A sharpener according to claim 1, wherein said plates are attached to a member which is pivotally mounted on a support for relative back and forth movement.

4. A sharpener according to claim 3, wherein said back and forth movement is limited by stop means, and said stop means is arranged so that the maximum degree of rearward tilt of said plates is greater than the maximum degree of forward tilt.

5. A blade sharpener including a sharpening mechanism which has a front side and a back side, a pair of cutter plates forming part of said mechanism and each having a front broad surface facing towards said front side, a back surface facing towards said back side, and an operative edge extending between those surfaces, said plates being relatively arranged so as to overlap and so as to form a generally vee shaped recess between said operative edges, and each said plate having a relatively sharp corner and a relatively blunt corner formed between said operative edge and said back and front surfaces respectively, said sharp corners being engageable by the cutting edge of a blade being moved longitudinally through said recess towards said front side and being operative to thereby sharpen that cutting edge, and said blunt corners being engageable by the cutting edge of a blade being moved longitudinally through said recess towards said back side and providing relatively low resistance to that movement.

6. A sharpener according to claim 5, including a housing having an elongate passage therein for receiving and storing a blade, an entrance opening at a front end of said housing through which a blade can be moved into and out of said passage, said mechanism being connected to said housing adjacent said opening and adjacent a base wall of said housing, and spring means connected to said housing and arranged to engage the back edge of a blade located in said passage so as to thereby press the cutting edge of that blade into engagement with said plates.

7. A sharpener according to claim 6, wherein said spring means includes a lever pivotally connected to said housing adjacent a top wall thereof and which depends from that pivotal connection to terminate adjacent said mechanism, and a spring member which urges said lever into a forward position at which its terminal end overlaps and is located rearwardly of said plates.

8. A sharpener according to claim 6, wherein said housing includes a body portion and a cap portion which is removably attached to a front end of said body portion, and said mechanism is mounted on said cap portion so as to be separable from said body portion with said cap portion.

9. A sharpener according to claim 8, wherein said spring means is mounted on said cap portion so as to be separable from said body portion with said cap portion.

10. A sharpener according to claim 8, wherein said cap portion includes a front wall, said opening is formed through that front wall, and both said spring means and said mechanism are located behind said front wall.

11. A sharpener according to claim 7, wherein said lower end of the lever is curved.

12. A sharpener according to claim 7, wherein said lever pivotal connection is located forward of said plates and said lever terminal end is located rearwardly of said plates in all pivotal positions of said lever.

13. A sharpener according to claim 8, wherein said cap portion is releasably attached to said body portion through upper and lower attachment means, said upper attachment means comprises cooperable parts on said cap portion and a top wall of said body portion respectively, and said lower attachment means comprises a deflectable catch formed integral with the base wall of said body portion and a cooperable part of said cap portion which is engageable by said catch.

14. A sharpener according to claim 8, wherein said body portion includes upper and lower parts, and said lower part includes a stirrup portion at a front end thereof and which forms part of said top wall.

15. A blade and sharpener combination wherein the sharpener is a sharpener in accordance with claim 11, and said blade has a cutting edge and a back edge which diverge away from a tip of the blade, both said cutting edge and said back edge are curved in their extent over an end portion of said blade terminating at said tip, the curvature of said cutting edge at said end portion is a relatively flat curvature, and the curvature of said back edge at said end portion is a relatively sharp curvature.

16. A blade sharpener including, a pair of cutter plates, each said plate having a front surface, a back surface, and an operative edge extending between those surfaces, said plates being relatively arranged so as to overlap and so as to form a generally vee shaped recess between said operative edges, a relatively sharp corner formed between each said operative edge and the respective said back surface, and a relatively blunt corner formed between each said operative edge and the respective said front surface, said sharp corners being engageable by the cutting edge of a blade being moved longitudinally through said recess towards said front surfaces and being operative to thereby sharpen that cutting edge, and said blunt corners being engageable by the cutting edge of a blade being moved longitudinally through said recess towards said back surfaces and providing relatively low resistance to that movement.

* * * * *